United States Patent [19]

Gibson et al.

[11] Patent Number: 4,554,901

[45] Date of Patent: Nov. 26, 1985

[54] FLUID DISTRIBUTING APPARATUS

[75] Inventors: Dennis H. Gibson, Edelstein; Alan R. Stockner, Chillicothe; Donald J. Waldman, Brimfield, all of Ill.

[73] Assignee: Caterpillar Tractor Co., Peoria, Ill.

[21] Appl. No.: 594,040

[22] Filed: Mar. 27, 1984

[51] Int. Cl.[4] ..... F02M 41/06

[52] U.S. Cl. ..... 123/450; 417/517

[58] Field of Search ..... 123/500, 450, 503, 502, 123/374, 364, 372, 501; 417/270, 517

[56] References Cited

U.S. PATENT DOCUMENTS

| | | | |
|---|---|---|---|
| 2,273,019 | 2/1942 | Butler | 123/374 |
| 3,181,520 | 5/1965 | Mock | 123/478 |
| 3,277,828 | 10/1966 | Ziegler | 137/330 |
| 3,509,823 | 5/1970 | Kemp et al. | 123/450 |
| 4,165,725 | 8/1979 | George et al. | 123/450 |
| 4,200,072 | 4/1980 | Bailey | 123/450 |
| 4,292,012 | 9/1981 | Brotherston | 123/450 |
| 4,336,781 | 6/1982 | Overfield | 123/450 |
| 4,364,360 | 12/1982 | Eheim et al. | 123/450 |
| 4,376,432 | 3/1983 | Davis | 123/450 |

FOREIGN PATENT DOCUMENTS

| | | |
|---|---|---|
| 1940995 | 3/1970 | Fed. Rep. of Germany . |
| 1207501 | 2/1960 | France . |
| 2352170 | 12/1977 | France . |

*Primary Examiner*—Magdalen Y. C. Moy
*Assistant Examiner*—David A. Okonsky
*Attorney, Agent, or Firm*—William C. Perry

[57] ABSTRACT

In the use of fuel injection pumps, a distributing rotor is often utilized to sequentially deliver fuel from an inlet to a combustion chamber on an engine in combination with one or more reciprocating high pressure pistons. Due to the positioning of the various passages through which the fuel is directed, cavitation of the pump is often experienced which has a very serious effect on the life of the components within the pump. The fluid distribution apparatus of the present invention provides a single delivery passage between the pumping chambers of the reciprocating pistons and the distributing rotor. With this arrangement, fluid that is communicated from the bore to the pumping chambers in response to the intake stroke of the pistons is directed back through the same passage during the pressurization stroke of the pistons. The positioning of the single delivery passage prevents the fuel injection pump. The positioning of the single delivery passages prevents the fuel injection pump from experiencing the severe cavitation that is common with previous designs and thus the fore-shortened life of the pump components.

7 Claims, 8 Drawing Figures

FLUID DISTRIBUTING APPARATUS

DESCRIPTION

1. Technical Field

This invention relates to a fuel injection pump and more particularly to the fluid distributing apparatus that is utilized to deliver fuel under pressure in timed relation to the combustion chamber of each cylinder of a multi-cylinder engine.

2. Background Art

Fuel injection pumps of previous designs have often delivered fuel to the combustion chambers of an engine through a distributor that is rotatably received within the housing of the pump. The distributor or rotor has a multiplicity of passages that sequentially communicate the fuel to injector lines that lead to the combustion chambers in response to one or more high pressure pumping units. The pumping units are generally of the reciprocating type having a piston member that is reciprocated within a pumping chamber by an engine driven mechanism. The drive mechanism simultaneously causes rotation of the rotor in timed relation to the reciprocation of the pumping units. Fuel is generally communicated to the individual pumping units from a low pressure transfer pump or the like. The fuel is communicated to the bore in which the rotor is disposed and then through an inlet passage to the pumping unit. The fuel is then highly pressurized by the reciprocation of the piston and communicated back to the bore by way of an outlet passage. The passages in the rotor register with the outlet passage from the pumping unit and the fuel is then sequentially delivered through the rotor to the injector lines. The registration between the porting in the rotor and the inlet passage leading to the pumping unit is critically timed with the stroking of the pump pistons as is the registry of the rotor ports with the outlet passage as previously described.

Typically, the fuel enters the inlet passage while the pump piston is moving towards an intake stroke. As the pump piston completes its intake stroke and reverses direction to begin a pressurization stroke, the fluid likewise reverses and is directed under pressure back toward the rotor through the outlet passage. As this occurs, communication between the inlet passage and the bore is subsequently blocked by rotation of the rotor as the outlet passage is opened to communicate with the radial ports in the rotor to provide a flow of fuel under pressure to the injector lines.

During this sequence, a problem known as cavitation has often been encountered. Cavitation occurs mainly in the inlet passage leading from the bore to the pumping unit. It occurs at a time when the fluid flow in the inlet passage is abruptly cut off by the rotation of the rotor. As described previously, when the piston is on its pressurization stroke, the fluid in the inlet passages is suddenly reversed by the ensuing pressure increase. When the rotor is rotated to completely close off the inlet passage, the fluid is thus driven against the rotor and actually rebounds sharply from its surface. As the fluid rebounds away from the surface of the rotor, a void in the fluid is created next to the surface. The rebounding fluid is again driven toward the rotor in response to the continued stroke of the piston and the subsequent flow of fluid to the injectors, and as a result, the void is collapsed. As the void is collapsed a minute implosion occurs that actually pulls particles of metal from the rotor thus creating an erosion of the surface. Upon erosion of the surface, not only do the metal particles become suspended in the fuel and find their way to the injectors and engine cylinders, but the fluid bearing between the rotor and the bore also starts to deteriorate. When this happens, metal to metal contact occurs between the rotor and the bore causing it to "stick" or seize in the bore.

Typical designs of this nature are disclosed in U.S. Pat. No. 3,181,520, issued to F. C. Mock on May 4, 1965; U.S. Pat. No. 3,277,828, issued to K. F. Ziegler on Oct. 11, 1966; and U.S. Pat. No. 4,376,432, issued to C. W. Davis on Mar. 5, 1983.

The present invention is directed to overcoming one or more of the problems as set forth above.

DISCLOSURE OF THE INVENTION

In one aspect of the present invention a fluid distributing apparatus is provided having a housing that defines a bore, a pumping chamber, and a low pressure fluid inlet that communicates with the bore. A piston is reciprocatingly disposed within the pumping chamber for movement in one direction to provide an intake stroke and in a second direction to provide a pressure stroke. A rotor having a fluid passageway defined therein is rotatably disposed in the bore. A single, dual flow delivery passage is provided to communicate the pumping chamber with the low pressure fluid inlet passage and the fluid passageway in the rotor.

With a fluid distributing apparatus of this type, the fluid that is communicated from the bore to the pumping chamber in response to the intake stroke of the piston, is directed back through the same passage during the pressurization stroke of the piston. Since the delivery passage, the inlet passage, and the fluid passageway in the rotor are all in selective communication along the same plane, they may be sized so that fluid is introduced into the fluid passageway of the rotor slightly before communication between the delivery passage and the inlet passage is cut off. Therefore the rebound of fluid that occurs in the prior art and the resulting cavitation is alleviated.

BEST MODE FOR CARRYING OUT THE INVENTION

Figure 1:
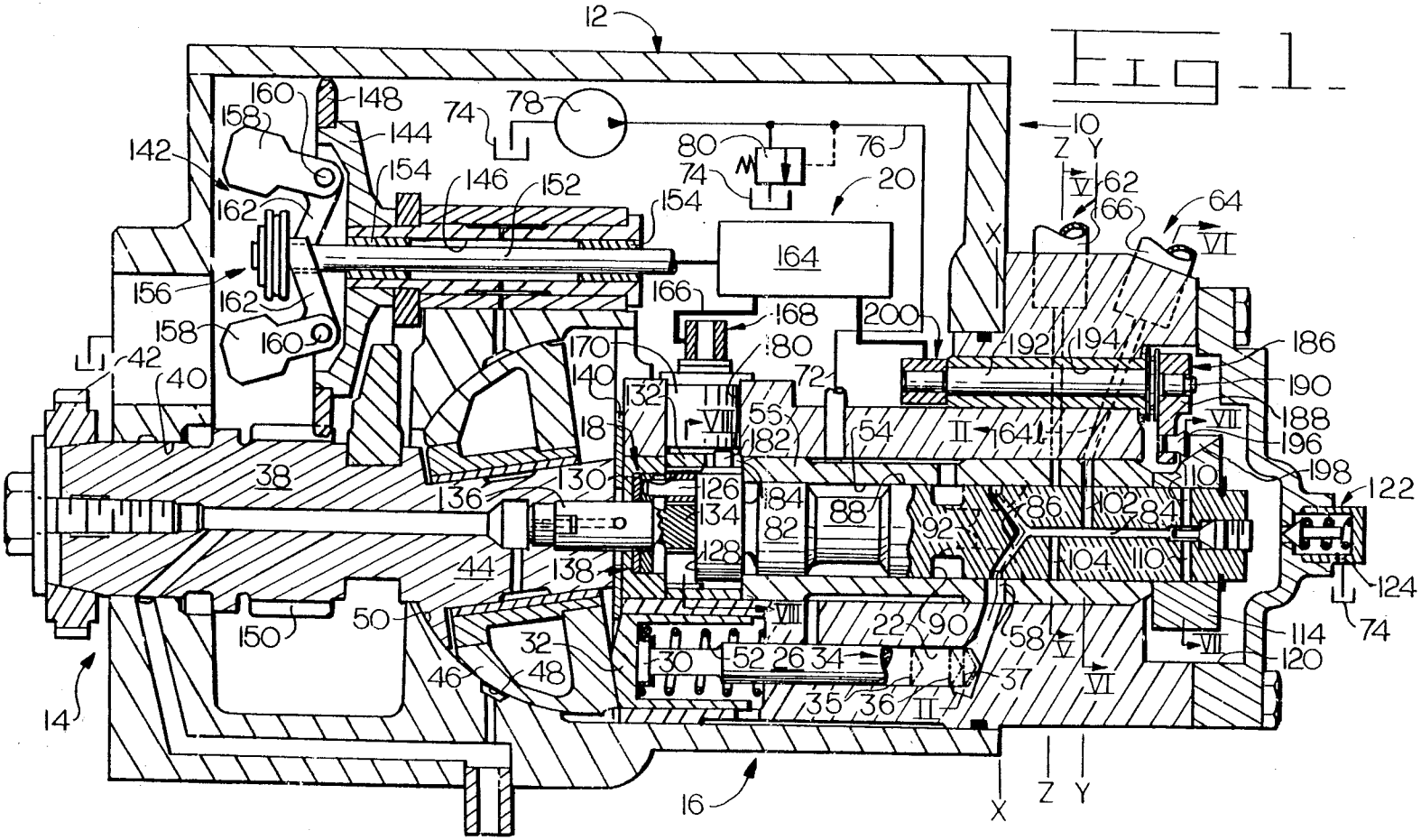
FIG. 1 is a diagrammatic cross-sectional view of a fuel pump that embodies the principles of the present invention.

Referring now to FIG. 1, a fuel injection apparatus is generally indicated by the reference numeral 10. The fuel injection apparatus includes a multi-sectional housing 12 having a pumping section 14, a distributing section 16, a planetary gear arrangement 18 driven by the pumping section 14 and drivingly connected to the distributing section 16, and a governing section 20.

The pumping section 14 is of the nutating type and includes a pair of pumping chambers 22 and 24 defined in the housing 12. A pair of pistons 26 and 28 are reciprocatably disposed in respective pumping chambers 22,24. As is shown in FIG. 1 wherein only piston 26 is shown, each piston has one end 30 thereof engaged with a plunger assembly 32. The other end 34 of the piston 26 as shown in FIG. 1 operates through a range of positions indicated by lines 35, 36 and 37. A drive shaft 38 is suitably journalled within a bore 40 of the housing for rotation in response to a drive arrangement (not shown) that engages a gear 42 fixedly secured to the drive shaft 38. The drive shaft 38 has an angled eccentric portion 44 formed thereon that in turn mounts a nutating member 46. The nutating member 46 has a spherical surface 48 seated in a mating concave spherical bearing surface 50 defined by housing 12. A spring 52 resiliently urges the one end 30 of the pistons and the plungers 32 into intimate contact with the nutating member 46 so that the plunger 32 will respond as a follower upon rotation of the nutating member 46.

Figure 2:
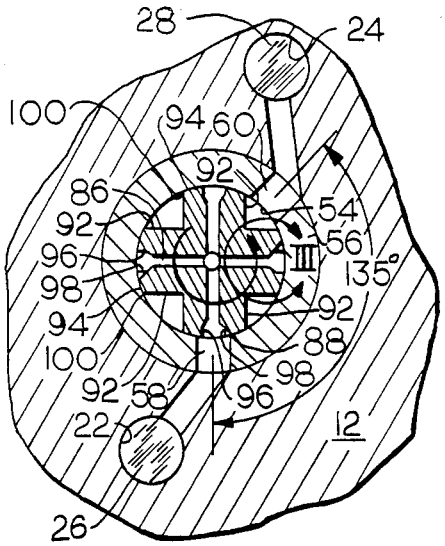
FIG. 2 is a cross-sectional view taken along lines II—II in FIG. 1.
Figure 5:
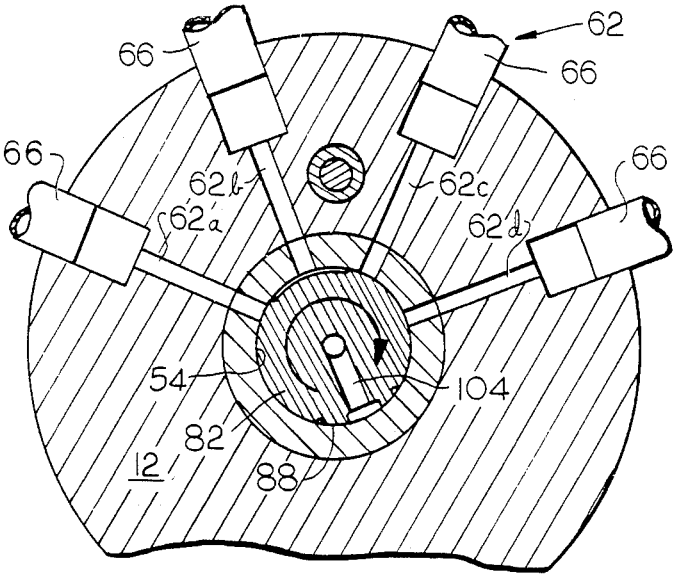
FIG. 5 is a cross-sectional view taken along lines V—V of FIG. 1.
Figure 6:
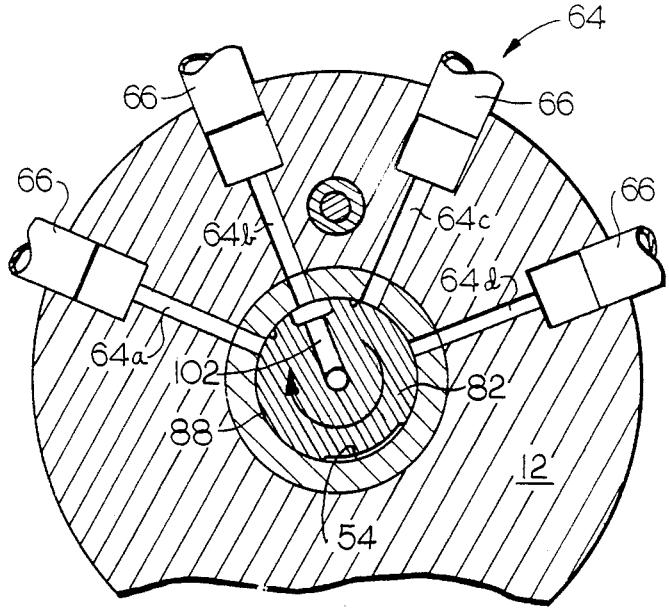
FIG. 6 is a cross-sectional view taken along lines VI—VI of FIG. 1.

The distributing section 16 includes a bore 54 formed in a sleeve 56 that is non-rotatably secured to the housing 12 in a well known manner. For purposes of clarity, the sleeve will be considered as an integral portion of housing 12 when reference is made thereto. A single delivery passage 58 and 60 communicate the bore 54 with each of the pumping chambers 22 and 24 respectively. The delivery passages 58 and 60 intersect with the bore 54 along a first plane X. As shown in FIG. 2, the passages intersect the bore at an angle of 135° to each other. A plurality of outlet passages are defined in the housing 12 by two separate groupings or banks of passages indicated generally by reference numerals 62 and 64. As shown in FIGS. 5 and 6 respectively, bank 62 defines outlet passages **62*a*, 62*b*, 62*c*, and 62*d*, while bank 64 defines outlet passages 64*a*, 64*b*, 64*c*, and 64*d*. The outlet passages in banks 62 and 64 communicate the bore 54 with a corresponding plurality of combustion chambers of an engine (not shown) by way of conduits 66. The outlet passages of bank 64 intersect the bore 54 along a plane Y and passages of bank 62 intersect the bore 54 along a plane Z. The planes Y and Z are axially spaced from and generally parallel to the plane X. An inlet passage 72 communicates the bore 54 with a low pressure source of fuel 74 through a conduit 76. The fuel is delivered to the bore by a transfer pump 78. A relief valve 80 is positioned in the conduit 76 between the bore 54 and the pump to deliver fuel back to the source 74** when the pressure in the conduit exceeds a preselected amount which in this instance is approximately 40 psi (275 kPa).

Figure 3:
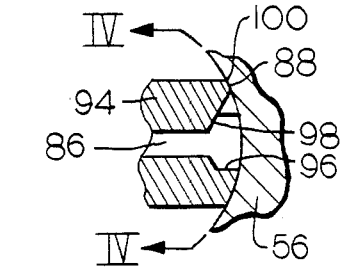
FIG. 3 is an enlarged view of a portion indicated on FIG. 2.
Figure 4:
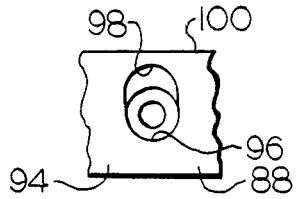
FIG. 4 is a view taken along lines IV—IV of FIG. 3.

A distributor rotor 82 is rotatably disposed within the bore 54 and has an axially extending passage 84 disposed therein. A plurality of first generally radially extending ports 86 communicate the axial passage 84 with a periphery 88 of the rotor 82. There are four of the first radial ports 86 which extend at 90° angles to each other and are configured so as to open onto the periphery 88 of the rotor along the plane X. An annular groove 90 is formed in the rotor 82 and is in continuous communication with the inlet passage 72. As is best shown in FIG. 2, a plurality of slots 92 are formed in a portion of the rotor 82 and are circumferentially spaced about the rotor to alternately form a series of scrolls or lands 94 between each of the slots 92. The slots 92 extend from the annular groove 90 a preselected axial distance along the rotor 82 and are in communication with the inlet passage 72. The axial extent of the slots 92 is sufficient to position a portion of the slots 92 along the first plane X for selective communication of the slots with the delivery passage 58,60 upon rotation of the rotor 82. The first radial ports 86 form an enlarged opening 96 on the surface of each of the scrolls 94, which openings are also selectively communicated with the delivery passage 58,60 upon rotation of the rotor 82. As can be seen in FIGS. 3 and 4, each opening 96 defines an enlarged portion or scallop 98 that extends toward a leading edge 100 of the scroll 94 which is defined by the rotor's direction of rotation. The enlarged portion is created by providing a secondary extension from the end of the first radial ports 86 toward the leading edge 100 of the scroll at an acute angle to the periphery 88 of the rotor 82.

Figure 7:
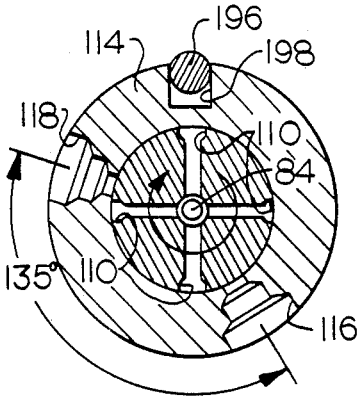
FIG. 7 is a cross-sectional view taken along lines VII—VII FIG. 1.

A second and third generally radially extending ports 102 and 104 also communicate the axial passage 84 with the periphery 88 of the rotor 82. The second port 102 is axially positioned to open onto the periphery 88 of the rotor 82 along plane Y while the third port 104 opens onto the periphery 88 of the rotor 82 along plane Z. As shown in FIGS. 1, 5 and 6, the second and third radial ports 102 and 104 open onto the periphery 88 of the rotor 82 at points 180° apart. Second radial port 102 sequentially communicates with the outlet ports of bank 64 while the third radial port 104 sequentially communicates with the outlet ports of bank 62. As shown in FIG. 7, a plurality of radial vent ports 110 are defined in the rotor 82 and are spaced from each other at 90° intervals. The vent ports 110 all communicate the axial passage 84 with the periphery 88 of the rotor 82. A metering collar 114 is rotatably positioned on the rotor 82 and has a pair of spill ports 116 and 118 defined therein at an angle of 135° to each other. The metering collar 114 is positioned to selectively communicate the spill ports 116,118 with the vent ports 110. This in turn directs fluid flow from the axial passage 84 to a spill chamber 120 in housing 12 which is in turn connectable to the fuel source 74 through a relief valve 122 and an exhaust port 124.

Figure 8:
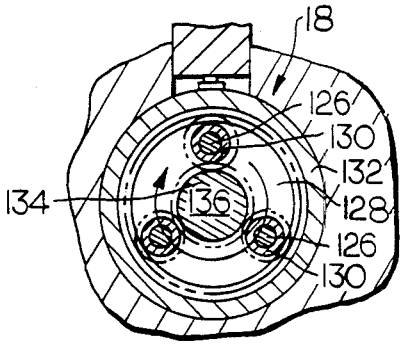
FIG. 8 is a cross-sectional view taken along lines VIII—VIII of FIG. 1.

The planetary gear arrangement 18 includes a plurality of carrier pins 126 connected to and extending axially from an end 128 of the rotor 82, as shown in FIGS. 1 and 8. Each of the carrier pins 126 rotatably carries a planet gear 130 which mesh with a ring gear 132 and a sun gear 134. The sun gear 134 is integrally connected to a shaft 136 drivingly connected to drive shaft 38. The end portion of the carrier pins extend into and support an annular thrust bearing assembly 138 which abuts a plate 140 that is suitably secured to the housing 12.

The governing section 20 includes a flyweight assembly 142 responsive to the speed of the drive shaft 38 of the pumping section 14 and hence to the speed of the engine to which the fuel injection apparatus 10 is connected. The flyweight assembly 142 includes a flyweight carrier 144 rotatably positioned within a bore 146 of the housing 12. A gear 148 is connected to the carrier 144 and meshes with a gear 150 formed on the drive shaft 38. A shaft 152 extends through a pair of axially spaced bearings 154 that are connected to the flyweight carrier 144 at one end thereof. A thrust bearing 156 is connected to the end of the shaft 152. A pair of flyweights 158 are pivotally mounted to the flyweight carrier 144 at pivots 160. Each flyweight 158 has an arm 162 extending generally radially inwardly in thrust producing contact with the thrust bearing 156. The shaft 152 is connected at its distal end to a governor control mechanism 164 that produces an output in response to the movement of the shaft 152.

A linkage means 166 is provided between the governor control mechanism 164 and the ring gear 132 to provide rotary motion of the ring gear 132 in response to input received from the governor control mechanism 164. The linkage means 166 includes a lever mechanism 168 which includes a cylindrical body 170 rotatably positioned within a bore 180 in the housing 12. A pin 182 extends from a lower end of the cylindrical body 170 and is eccentrically disposed relative to the longitudinal axis of the cylindrical body 170. The pin 182 extends into a slot 184 defined in the ring gear 132 and causes rotation of the ring gear 132 about the axis of the rotor 82 in response to the rotation of the cylindrical body 170.

Another linkage means 186 is provided between the governor control mechanism 164 and the metering collar 114 to provide rotary motion of the metering collar 114 in response to input received from the governor control mechanism 164. The linkage means includes a lever arm 188 that is suitably secured to one end 190 of a shaft 192 that is pivotally received within a bore 194 in the housing 12. A pin 196 is connected to the lever arm 188 and extends into a slot 198 formed in metering collar 114. The opposite end 200 of the shaft 192 is connected to the governor control mechanism 164 and receives a rotary input therefrom which is then translated into rotary motion of the metering collar 114 with respect to the rotor 82.

Industrial Applicability

In operation, the drive shaft 38 of the fuel injection apparatus 10 is driven at two times the speed of an engine (not shown) through the engagement of the gear 42 with a speed increasing mechanism (not shown). The rotation of the shaft 38 and thus the nutating member 46 causes the plungers 32 and the pistons 26 and 28 reciprocated within the pumping chambers 22 and 24. The pistons 26 and 28 are moved within the pumping chambers between the extreme positions indicated by phantom lines 35 and 37 in FIG. 1. Being positioned in diametrically opposed relation to each other (FIG. 2) the pistons 26 and 28, while moving at the same velocity, move in opposite directions. While the drive shaft 38 is rotating at twice the rpm of the engine, the rotor 82 through its connection with the planetary gear arrangement 18, is being driven in the direction indicated by the arrows shown in FIGS. 2 and 5–8 at one half the rpm of the engine. As the fuel injection apparatus 10 is driven, injection of the fuel to the combustion chambers of an engine is controlled by the interrelated movement of the rotor 82 and the metering collar 114, which movement is in turn coupled with the geometric positioning of the various ports and passageways within these two components and the housing 12. As a result, fuel from the transfer pump 78 is delivered through the conduit 76 to the bore 54 under relatively low pressure where it is communicated with the annular groove 90.

Referring to FIGS. 1–7, the injection cycle begins with the intake stroke of the pistons 26 and 28 as they move in a first direction, or leftwardly as viewed in FIG. 1. The fuel fills one of the delivery passages 58 and 60 when one of the delivery passages is in registry with one of the slots 92, as delivery passage 60 is shown in FIG. 2. The fuel in the delivery passage 58 and 60 subsequently fills the corresponding pumping chamber 22 and 24. For the sake of clarity, and to maintain correlation with the drawings, the remainder of the sequence will be related to delivery port 58 and piston 26. Assuming the piston 26 has already completed its intake stroke and that fuel has filled the delivery passage 58 and the pumping chamber 22, the piston will be positioned at a point generally indicated by line 35 in FIG. 1. From there the piston will move to the right as viewed in FIG. 1, to begin a pressurization stroke. With the initiation of the pressurization stroke, the fuel is forced from the pumping chamber 22 back through the delivery passage 58 and the slot 92. Since fluid flows into and out of the delivery passage 58, it can be seen that it acts in a dual flow capacity. Since the pressure is now much higher than the pressure of fuel being delivered by the transfer pump 78, the fuel is forced back into the conduit 76 where it is returned to the fuel source 74, which in this instance is a fuel tank, by the relief valve 80. As the sequence continues the scroll 94 of the rotor 82 reaches a position to block communication between the slot 92 and the delivery passage 58 as shown in FIG. 2. Just prior to reaching this position, the enlarged portion 98 of opening 96 of one of the first radial ports 86 (FIGS. 3 and 4) is communicated with the delivery passage 58. As the fuel enters the first radial port 86, it is communicated through the axial passage 84, the second radial port 102, and finally through one of the outlet passages **64*b* of bank 64 (FIG. 6) where it enters one of the conduits 66 for delivery to the corresponding combustion chamber. During this portion of the injection sequence, the end 34 of the piston 26, as viewed in FIG. 1, will generally be positioned at a point indicated by line 36. Referring now to FIG. 7, delivery of the fuel as described above continues until one of the radial vent ports 110 in the rotor 82 becomes open to one of the spill ports 116 and 118 in the metering collar 114, whereupon the injection to that particular combustion chamber is terminated. During the remaining stroke of the piston 26, the fuel will be bypassed into the spill chamber 120. When the pressure in the spill chamber 120 exceeds a preselected value, the relief valve 122 is opened and the fuel is directed back to its source 74. When the piston 26 reaches the end of the stroke as is generally indicated by line 37 in FIG. 1, the piston 26 will then reverse direction. At this point, the orientation of the rotor 82 with the delivery port 60 is such that communication between the delivery port 60 and the slot 92 is about to be blocked, thus beginning an injection from piston 28. The fuel that is delivered by piston 28 is then directed through the first radial port 86, the axial passage 84, and the second radial port 102 to the outlet passage 64*c*, for delivery of fuel to another combustion chamber. It can be seen that with each 45° degree revolution of the rotor 82, fuel is delivered to a different outlet passage in the bank 64. When the second radial passage 102 is moved out of communication with the last outlet passage 64*d* in the bank 64, the third radial passage 104 is moved into communication with the first outlet passage 62*a* in the bank 62. Thus it can be seen that with the drive shaft 38 rotating at two times the engine rpm, each piston is moved through four complete pumping strokes for 720° of engine crankshaft rotation, which is the interval required for a complete cycle in 4 cycle engines. In other words, each of the two diametrically opposed pistons 26 and 28** supply injections to the combustion chambers of four of the cylinders in the proper sequence for an even firing eight cylinder engine.

The linkage means 166 controls the rotary position of the ring gear 132 which in turn controls the timing phase relationship between the rotor 82 and the drive shaft 38 and hence the timing phase relationship between the axial passage 84 in the rotor 82 and the delivery passages 58 and 60. This controls the start of fuel delivery from the delivery passage 58 and 60 through the rotor 82 to each of the outlet ports in banks 62 and 64 and thereby determines the initiation of fuel injection commonly referred to as engine timing. Rotating the ring gear 132 in a first direction advances the engine timing while rotating the ring gear in the second direction retards the engine timing.

The linkage means 186 controls the rotary position of the metering collar 114 which in turn controls the timing phase relationship between the axial passage 84 and the spill ports 116 and 118 in the metering collar. Opening the passage 84 into the spill ports 116 and 118 terminates the fuel injection and thus the metered quantity of fuel delivered through the respective outlet ports for determining the operating speed of the engine. For example, rotating the metering collar 114 in a first direction increases the metered quantity of fuel delivered through each outlet port thereby increasing engine speed while rotating the metering collar in a second direction decreases the metered quantity of fuel delivered through each outlet port thereby decreasing the engine speed.

While the embodiment described above is for an even firing eight cylinder engine, the basic design can be altered to accommodate various other even firing engines by providing variations of the number of pumping chambers, metering scrolls and passages and their angular relationship with respect to the pump center.

With a fuel distributing apparatus 10 as described above, it can be seen that in the injection cycle of each pumping unit, the fuel is both drawn into and delivered from the pumping chambers 22,24 through a single delivery port 58 and 60. As this happens, the fuel under pressure is simultaneously, albeit ever so briefly, communicated back into the slots 92 from which it was drawn, as well as being directed into one of the first radial ports 86. With such an arrangement the fuel that is under great pressure is not allowed to rebound from the surface of the scrolls 94 as they block the delivery ports 58 and 60 because introduction of the fuel into the first radial port 86 has already begun. Also, due to the placement of the enlargement 98 in the opening 96 of the first radial ports 86, fuel is directed into the first radial port 86 rather than merely being allowed to seek its own path. This greatly reduces erosion of the scroll surface 94 of the rotor 82.

Other aspects, objects and advantages of this invention can be obtained from a study of the drawings, the disclosure and the appended claims.

We claim:

1. A fluid distributing apparatus, comprising:

a housing defining a bore, a pumping chamber, and a low pressure fluid inlet passage communicating with the bore;

a piston reciprocatingly disposed within said pumping chamber for movement in one direction to provide an intake stroke and movement in a second direction to provide a pressure stroke;

a rotor having a fluid passageway defined therein, said passageway having a portion thereof in communication with a peripheral surface of said rotor, said rotor being rotatably disposed within said bore;

a single, dual flow delivery passage communicating the pumping chamber with the bore and being in alternate communication with the low pressure fluid inlet passage and the fluid passageway in the rotor; and means for directing fluid from said single, dual flow delivery passage to the first radial ports to minimize directional changes of fluid, said directing means opening onto the peripheral surface of the rotor and includes a relief positioned on the leading edge of the opening to intersect the opening at an acute angle with respect to the peripheral surface of the rotor.

2. A fluid distributing apparatus as set forth in claim 1 wherein the fluid directing means further includes an enlarged inlet opening that opens onto each of a plurality of scrolls that are formed on the periphery of the rotor by a plurality of circumferentially spaced slots along a first axially positioned plane, said relief being positioned on the leading edge of said opening to place the fluid passageway and said slots in alternate communication with the single, dual flow delivery passage upon rotation of the rotor.

3. A fluid destributing apparatus, comprising:

a housing having a bore defined therein, a pumping chamber, a plurality of outlet passages in communicaton with the bore, and a single delivery passage communicating the pumping chamber with the bore, said delivery passage intersecting said bore along a first axially positioned plane;

a piston reciprocatingly disposed within said pumping chamber for movement in a first and second direction;

a rotor rotatably disposed within the bore and having a peripheral surface, an axial passage, a plurality of first generally radially extending parts communicationg the axial passage and the periphery of the rotor, said first radial ports opening onto said periphery along said first plane, a second generally radially extending port communicating the axial passage with the periphery of the rotor, said second radial port opening onto the periphery along a second plane that is axially spaced from and parallel to the first plane, a plurality of axially extending slots defined in the rotor, said slots being circumferentially spaced about the rotor and having a portion thereof positioned along the first plane, said slots and said first radial ports being in selective communication with the delivery passage and said second radial port being in selective communication with the outlet passages upon rotation of the rotor; and means for directing fluid from the delivery passage to the first radial ports to minimize directional changes of the fluid as it passes therebetween, said fluid directing means being positioned on the periphery of the rotor at a point where the first radial ports open thereon and includes a relief positioned on a leading edge of the opening to intersect the opening at an acute angle with respect to the peripheral surface of the rotor.

4. The fluid distributing apparatus as set forth in claim 3 wherein fluid is communicated from the delivery passage to the outlet passages when one of the first radial ports is in communication with the delivery passage and the piston is moving in said second direction, said piston being capable of generating fluid pressure in excess of 55,000 kPa.

5. The fluid distributing apparatus, as set forth in claim 3 wherein said fluid directing means further includes an enlarged inlet opening, said relief being positioned on a leading edge of said opening.

6. The fluid distributing apparatus as set forth in claim 3 wherein the circumferential spacing of the slots about the rotor forms a plurality of scrolls along the periphery of the rotor between each of the slots.

7. The fluid distributing apparatus as set forth in claim 6 wherein the fluid directing means opens onto each of the scrolls of the rotor.

* * * * *